US012298022B2

(12) United States Patent
Folts

(10) Patent No.: US 12,298,022 B2
(45) Date of Patent: May 13, 2025

(54) DYNAMIC DEADBAND

(71) Applicant: Addison HVAC LLC, Orlando, FL (US)

(72) Inventor: Leon W. Folts, Apopka, FL (US)

(73) Assignee: Addison HVAC LLC, Orlando, FL (US)

( * ) Notice: Subject to any disclaimer, the term of this patent is extended or adjusted under 35 U.S.C. 154(b) by 669 days.

(21) Appl. No.: 17/540,003

(22) Filed: Dec. 1, 2021

(65) Prior Publication Data

US 2022/0170660 A1 Jun. 2, 2022

Related U.S. Application Data

(60) Provisional application No. 63/119,762, filed on Dec. 1, 2020.

(51) Int. Cl.

| | |
|---|---|
| ***F24F 11/64*** | (2018.01) |
| ***F24F 1/022*** | (2019.01) |
| ***F24F 11/83*** | (2018.01) |
| *F24F 110/12* | (2018.01) |

(52) U.S. Cl.

CPC ..... *F24F 11/64* (2018.01); *F24F 1/022* (2013.01); *F24F 11/83* (2018.01); *F24F 2110/12* (2018.01)

(58) Field of Classification Search

CPC .. F24F 11/64; F24F 11/83; F24F 1/022; F24F 2110/12

See application file for complete search history.

(56) References Cited

U.S. PATENT DOCUMENTS

| | | | | |
|---|---|---|---|---|
| 3,505,828 | A * | 4/1970 | Molen | G05D 23/1906 310/159 |
| 4,689,967 | A | 9/1987 | Han et al. | |
| 5,924,486 | A * | 7/1999 | Ehlers | F24F 11/62 165/238 |
| 6,044,652 | A * | 4/2000 | Nishihara | F24F 11/83 165/208 |
| 6,478,084 | B1 | 11/2002 | Kumar et al. | |
| 6,540,148 | B1 * | 4/2003 | Salsbury | F25B 49/022 236/1 EA |
| 2004/0050080 | A1 * | 3/2004 | Eisenhower | F25B 49/02 62/215 |
| 2008/0314998 | A1 * | 12/2008 | Herzon | F24F 11/77 236/1 C |

(Continued)

FOREIGN PATENT DOCUMENTS

| | | | |
|---|---|---|---|
| JP | 4711852 | B2 | 6/2011 |
| JP | 2011-214797 | A | 10/2011 |
| KR | 10-1985-0008208 | A | 12/1985 |

OTHER PUBLICATIONS

International Search Report and Written Opinion filed in PCT/US2021/061454 dated Mar. 24, 2022; 5 pages.

*Primary Examiner* — Nelson J Nieves

(74) *Attorney, Agent, or Firm* — Vedder Price P.C.

(57) ABSTRACT

A method for an automatic direct expansion rooftop heating and cooling equipment sequence control, including the steps of determining capacity of the unit via temperature drop or rise and stabilization over a given time period; automatically adjusting a deadband around a setpoint, with the purpose of reducing or eliminating fixed staged compressor cycling while controlling supply air temperature or dewpoint or other sensor input.

27 Claims, 8 Drawing Sheets

(56) References Cited

U.S. PATENT DOCUMENTS

| | | | | |
|---|---|---|---|---|
| 2012/0078423 | A1* | 3/2012 | Zhou | G05D 23/1902 236/47 |
| 2015/0276495 | A1* | 10/2015 | Smullin | G06Q 10/10 702/130 |
| 2018/0187913 | A1* | 7/2018 | Kolk | F24F 11/65 |
| 2018/0274836 | A1* | 9/2018 | Tsuji | F25B 49/022 |
| 2019/0203996 | A1* | 7/2019 | Crane | H02P 29/64 |
| 2019/0263218 | A1* | 8/2019 | Gough | B60H 1/00364 |
| 2020/0064033 | A1* | 2/2020 | Ostrye | F25B 49/022 |
| 2021/0127854 | A1* | 5/2021 | Krishnamoorthy | A47F 3/043 |

* cited by examiner

DYNAMIC DEADBAND

CROSS-REFERENCE TO RELATED APPLICATION

This Application claims the benefit of and priority to U.S. Provisional Application No. 63/119,762, filed Dec. 1, 2020, the content of which is hereby incorporated by reference.

FIELD OF THE DISCLOSURE

The present disclosure generally relates to an improved method of direct expansion equipment control by reduction or elimination of fixed staged compressor cycling. More particularly, the present disclosure is directed to a method of equipment control sequence that automatically calculates real-time performance response parameters that feed the alteration of a deadband and adjusts the deadband around a setpoint the equipment is controlling.

BACKGROUND

Conventional heating and cooling systems in building rooftops maintain satisfactory thermal conditions and indoor air quality for building occupants by setting thermostat setpoint ranges (or deadbands) within a narrow preferred range. Typically, rooftop heating and cooling equipment (e.g., HVAC units) generally goes through multiple energy cycling in maintaining their occupied spaces within acceptable operating temperature ranges.

The industry typically uses a Proportional-Integral-Derivative (PID) control for modulating equipment. However, PID parameters are not properly tuned on a large percentage of industrial equipment. Therefore, this type of control is not optimal for fixed- or single-stage equipment and generates excessive cycling of the motors due to the improper tuning of the PID. Even if properly tuned, PID control offers little improvement over a simple static hysteresis control with a deadband.

It is well known within the industry that different types of controllers and sensors have different capabilities as well as operating accuracies when it comes to regulating and managing equipment such as rooftop HVAC units. The capabilities can range from using simpler thermostat control to regulate temperature bands having fixed differentials, fixed deadbands to software-controlled equipment providing minimal adjustable temperature control. However, the current state of the art is limited in terms of implementing efficient energy management control strategies.

Heating and cooling equipment design generally exert system control by using a deadband—a certain temperature range in which neither heating nor cooling of the system is activated. In conventional equipment a temperature sensor and controller regulates the equipment via control algorithms that can be used for energy efficiency by setting up different ranges of deadbands around certain performance parameter setpoints related to the functioning of the equipment (or the capacity of the equipment). However, such conventional units are almost always in need of additional capacity. Repetitive fixed stage compressor cycling while addressing the additional capacity causes excessive wear and tear of the equipment. The issue of wear and tear is further accentuated for equipment with single stage compressor capacity and extraneous power consumption cycles.

In addition, adjusting the deadband for extended fixed-stage operation allows the system to return to original setpoint when the calculated deadband is exceeded (demand satisfied) by the fixed stage and is deenergized. Further, fixed dead bands in hysteresis or PID control do not account for in situ performance evaluation to be determined. These are set either by the manufacturer or the installer and never changed again. Deadbands can be manually adjusted after installation in attempts to gain better performance. However, doing so typically involves using a trial-and-error approach not based on the equipment's installed performance.

Currently available control technology used in heating and cooling equipment lacks provisions for continuous adjustment of setpoint deadband based on timed controlled measurement of the fixed stage within an equipment. There is a dearth of control mechanisms that can leverage the time-limited control variable measurement to determine capacity via automatic deadband adjustment around a setpoint controlled by the equipment. In other words, current systems lack controls wherein deadbands are automatically adjusted to ensure continuous operation as long as possible—while reducing or even eliminating the need for compressor cycling.

There is clearly a market need for a simple and efficient heating and cooling system comprising an automatic method of direct expansion air conditioning control sequence that determines real-time capacity of the unit by automatic feeding of the alteration of a deadband around a setpoint controlled by the equipment.

The present disclosure is directed to such a novel and improved method of direct expansion air conditioning control by reducing or eliminating fixed staged compressor cycling.

SUMMARY

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one of ordinary skill in the art to which this disclosure relates.

Embodiments disclosed in the present disclosure provide a novel and improved method of automatically calculating real-time performance response parameters that feeds the alteration of a deadband and adjusts the deadband around a setpoint the equipment is controlling.

The present disclosure is directed to an improved system and a method for a direct expansion rooftop equipment (e.g., HVAC) sequence control using a proprietary algorithm. The system and method are configured to determine the capacity of the unit by automatically calculating real-time performance response parameters that feed the alteration of a deadband and adjust the deadband around a setpoint the equipment is controlling.

In an aspect of the present disclosure, the system and method comprise a proprietary algorithm that calculates real-time performance of the equipment based on certain sensor readings. The system is then programmed with a proprietary algorithm to feed the alteration of a deadband around a setpoint the equipment is designed to control based on such sensor readings to ensure continuous equipment operation. The proprietary algorithm (the DD program) activated within the programmable (or program) logic unit of the equipment is configured to calculate real-time performance response that feeds the alteration of a deadband around a setpoint the equipment is designed to control. The programmable logic unit comprises a programmable logic controller having a memory and is in electronic communication with at least one processor. The programmable logic controller is further configured to run a proprietary algorithm (the DD program)—the control algorithm.

The setpoint can comprise supply air dry bulb temperature or dew point temperature within the equipment. The system and method are further configured for reducing or eliminating fixed-staged compressor cycling by automatic adjustment of the deadband around the setpoint while controlling the partial capacity loading of any incoming air within the equipment.

This summary is provided to introduce a selection of concepts in a simplified form that are further described in the detailed description of the disclosure. This summary is not intended to identify key or essential inventive concepts of the claimed subject matter, nor is it intended for determining the scope of the claimed subject matter. The references made above in detail to the embodiments of the disclosure are provided by way of explanation of the disclosure, not in limitation of the disclosure. It will be apparent to those skilled in the art that various modifications and variations can be made in the present disclosure without departing from the scope or spirit of the disclosure.

Features illustrated or described as part of one embodiment can be used on another embodiment to yield a still further embodiment. Thus, it is intended that the present disclosure cover such modifications and variations as come within the scope of the appended claims and their equivalents. Other objects, features and aspects of the present disclosure are disclosed in the following detailed description. It is to be understood by one of ordinary skill in the art that the present discussion is a description of exemplary embodiments only and is not intended as limiting the broader aspects of the present disclosure, which broader aspects are embodied in the exemplary constructions.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION OF THE DISCLOSURE

Figure 1:
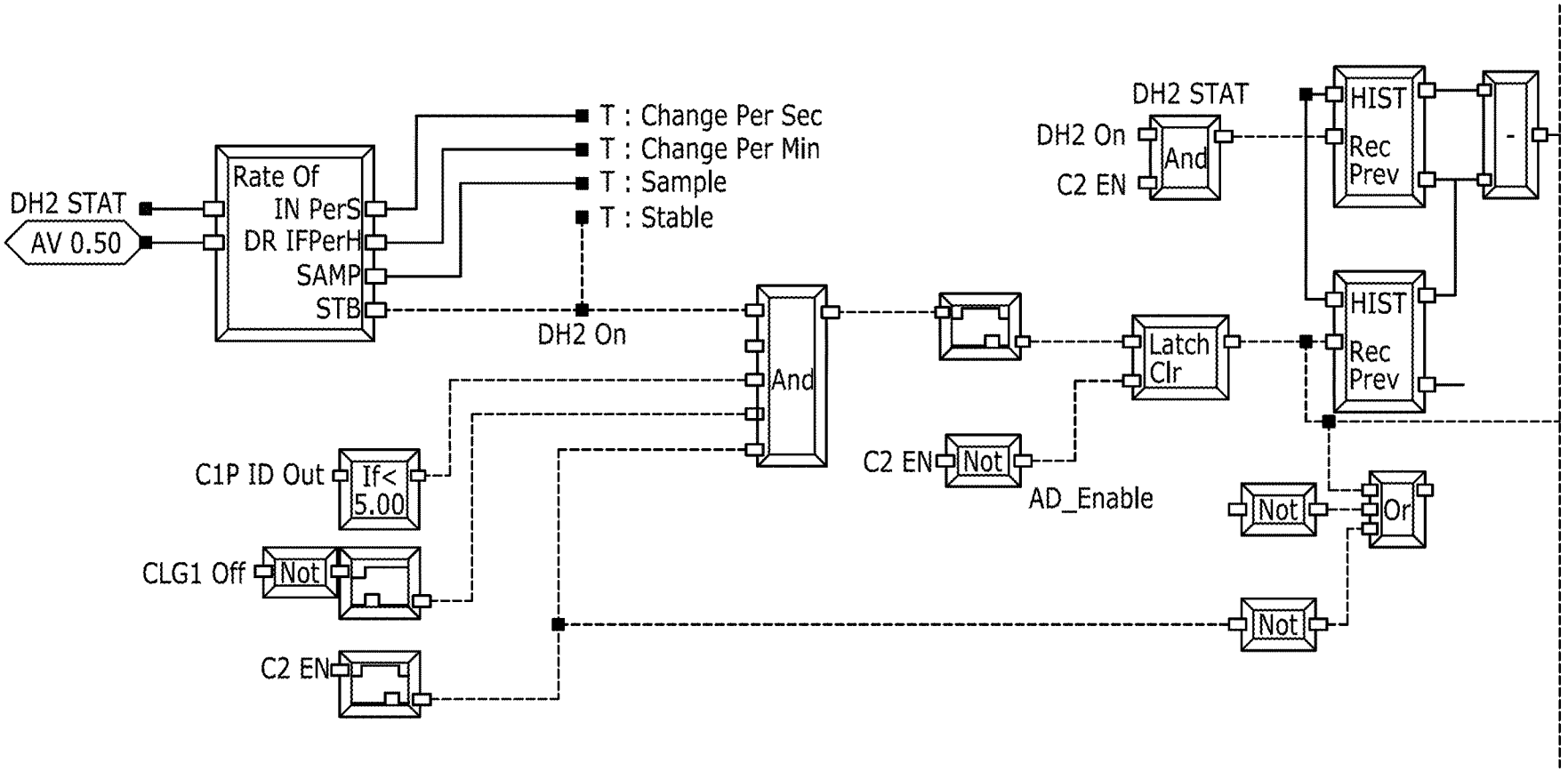
FIG. 1 is a flow-chart illustrating the logic for the DD implemented using Automated Logic's Eikon logic blocks.
Figure 1:
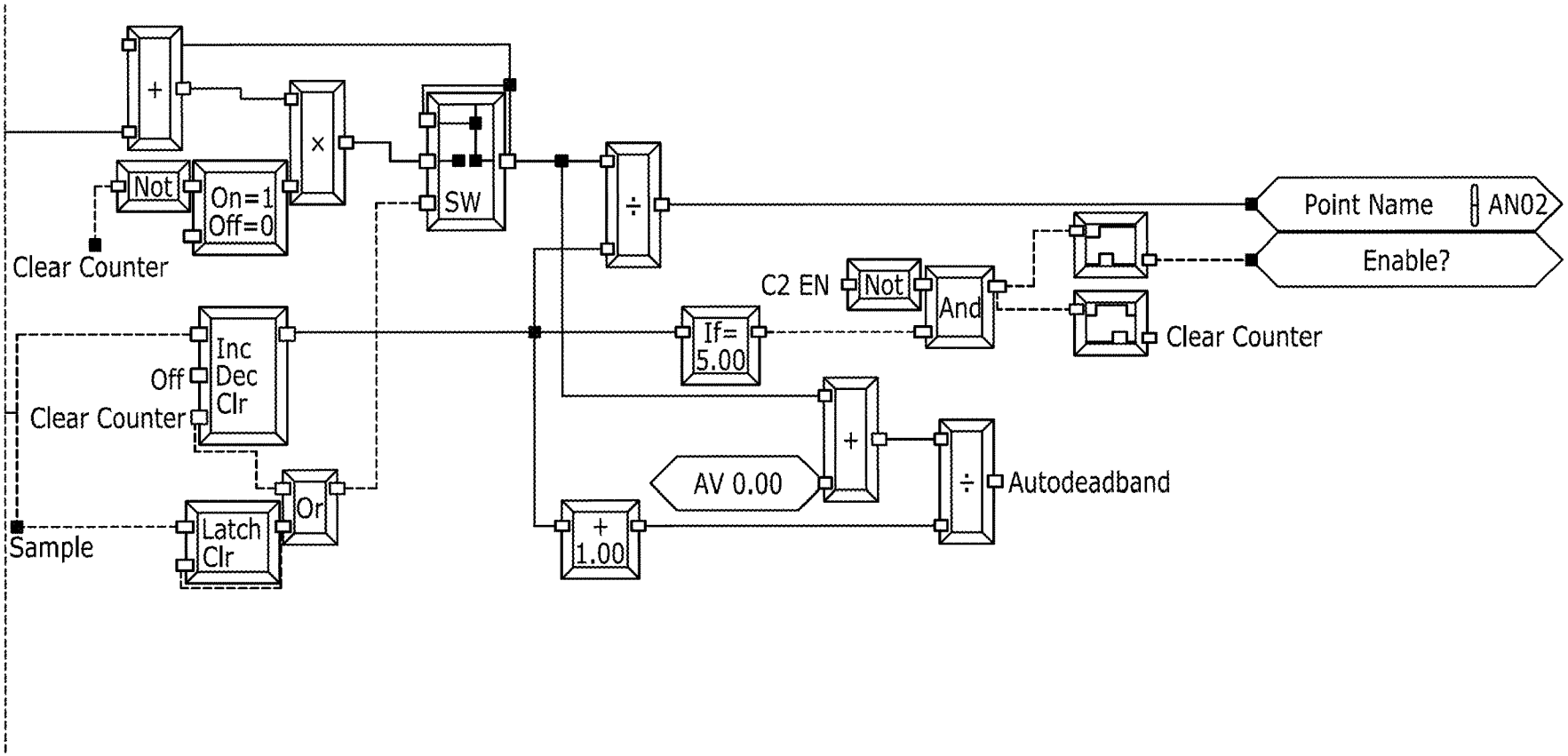

For the purposes of promoting and understanding the principles disclosed herein, reference is now made to the preferred embodiments illustrated in the drawings, and specific language is used to describe the same.

It is understood that no limitation of the scope of the disclosure is hereby intended. Such alterations and further modifications in the illustrated apparatus and such further applications of the principles disclosed and illustrated herein are contemplated as would normally occur to one of ordinary skill in the art to which this disclosure relates.

The present disclosure is directed to an improved method for a direct expansion rooftop equipment (e.g., HVAC) control. The method comprises the steps of: (1) determining the capacity of the unit via a variation of temperature and stabilization over a given time period; (2) automatically adjusting a deadband around a setpoint; and (3) reducing or eliminating fixed staged compressor cycling via controlled measurement of readings from various sensor inputs. The method is further configured to determine capacity of the unit by automatic adjustment of the deadband around the setpoint while controlling the partial capacity loading of any incoming air within the equipment.

The system disclosed herein is configured to determining the full extent that a fixed compressor system can improve air conditions and altering the deadband according to that extent, the HVAC system can operate at its designed efficiency. During operation, when the control determines that the demand requires a primary or additional stage of DX cooling or heating, running that stage continuously is the most efficient way to deal with partial loading. One of the primary reason that this occurs is due to the cycling of the compressor introducing "inrush current" during each energization to get the compressor moving from standstill. This is a large instantaneous demand on the power grid providing power to the unit.

In one aspect of the present disclosure, a control system for an automatic direct expansion rooftop equipment (e.g., HVAC unit) sequence is provided. The system is designed to reduce or even eliminate compressor cycling and thereby prevent excessive wear and tear of the equipment. The system comprises a proprietary algorithm that calculates real-time performance of the equipment based on certain sensor readings. The system is then programmed to feed the alteration of a deadband around a setpoint the equipment is designed to control based on such sensor readings to ensure continuous equipment operation. The setpoint can comprise supply air dry bulb temperature or dew point temperature related to the equipment.

In another aspect of the present disclosure, a control system for a direct expansion rooftop equipment—a heating and cooling equipment—sequence is provided, wherein the equipment comprises at least two (2) DX refrigerant compressors and corresponding heat exchangers. The compressors can either include a modulating/variable capacity motor and/or a fixed capacity motor with a single discreet stage.

In another aspect of the present disclosure, DD is designed to work with processes within the unit itself, typically with fast-acting events like supply air temperature or humidity, or DX coil leaving air temperature (the air immediately after it passes over the evaporator coil). DD is not the most optimum application for controlling slower-moving processes like indoor zone temperature or humidity (e.g., a recirculating air application). However, using DD for mechanical cooling "beyond" what the partial capacity needs in an unit—results in better control of the space and reduces load of other recirculating equipment controlling the zone sensors.

In another aspect of the present disclosure, a control system for an automatic direct expansion rooftop equipment (e.g., HVAC unit) sequence control is provided wherein the adjustment of a setpoint deadband is based on timed capacity measurement of the fixed-stage compressor. The control system disclosed herein uses a time-limited control variable measurement to create a deadband adjustment and limit or eliminate short cycling of the fixed-stage compressor. By determining the full extent that a fixed compressor system can improve air conditions and altering the deadband accordingly to that extent, the HVAC system can operate at its designed efficiency. When the control determines the demand requires a primary or additional stage of DX cooling or heating, running that stage continuously is the most efficient way to deal with partial loading. One reason this is true is that cycling the compressor introduces "inrush current" to each energization to get the compressor moving from a standstill. This is a large instantaneous demand on the power grid providing power to the unit.

It is to be further noted that the requirement for additional capacity is determined before the DD is activated. In an aspect of the present disclosure, a PID control loop comprises of a supply air temperature/dew point setpoint, supply air temperature and relative humidity sensors as the control variable. In the depicted embodiment, the output of the PID control block controls the modulation of the compressor(s). During operation of the system disclosed herein, when programming logic determines that one of the fixed stages of DX cooling is required, the corresponding single-stage compressor is energized and DD begins to process and calculate as required for the additional capacity.

In other aspects of the present disclosure, a DD program is activated within the program logic unit when the system senses that additional capacity is required (with an optional first variable compressor already running). The DD program is configured to measure an input from the control sensor (e.g., supply air temperature) before energizing additional compressors and then storing the measurement ($Temp_{before}$) within the program.

In another aspect of the present disclosure, a control system for an automatic direct expansion rooftop equipment sequence having a Dynamic Deadband™ (DD) program is provided. The proprietary DD program activated within the programmable (or program) logic unit of the equipment is configured to calculate a real-time performance response that feeds the alteration of a deadband around a setpoint the equipment is designed to control. During operation, once a fixed compressor is energized, the DD program further commands the compressor to run until the sensor measurement does not change more than a certain pre-programmed amount (e.g., $Temp_{drift}$) within a certain pre-determined time period (e.g., $Time_{seconds}$). The DD program logic of the system disclosed herein is further configured to determine the stabilization of the sensor and subtract the resulting sensor reading from the reading before the compressor was energized and output a calculated temperature capacity, or capacity in delta t (Absolute value of ($Temp_{before}$−$Temp_{after}$=$Cap\Delta_t$)).

In another aspect of the present disclosure, the calculated temperature capacity or capacity in delta t (Absolute value of ($Temp_{before}$−$Temp_{after}$=$Cap\Delta_t$)) by the DD program is used by the system to adjust the deadband around the setpoint to ensure continued operation as long as possible, thereby reducing or eliminating compressor cycling. the DD program logic is further configured to store the average of at least the past five compressor starts (CapΔt), which helps to further stabilize the deadband response and tune and align the equipment to external conditions.

In other aspects of the present disclosure, during cooling the lower deadband is extended by two degrees beyond the stabilized temperature, not to be lower than 42 degrees Fahrenheit to avoid coil freezing. Further, setting the lower temperature limit for the compressor that is operating to the DD—protects the equipment from freezing the cooling (evaporator) coil. For instance, if the air leaving is around 42 degrees Fahrenheit, the actual coil is colder and should it approach 32 degrees Fahrenheit, water that has condensed on the coil will freeze, impeding airflow and potentially damaging the system. One other benefit to this lower limit is that, as a dedicated outdoor air system, should the outside air drop in temperature enough such that the temperature drop across the coil drops below this lower limit, outdoor air may be in the range (~55 F) wherein it no longer requires conditioning before entering the building space.

FIG. 1 illustrates the logic for the DD implemented using Automated Logic's Eikon logic blocks.

Figure 2:
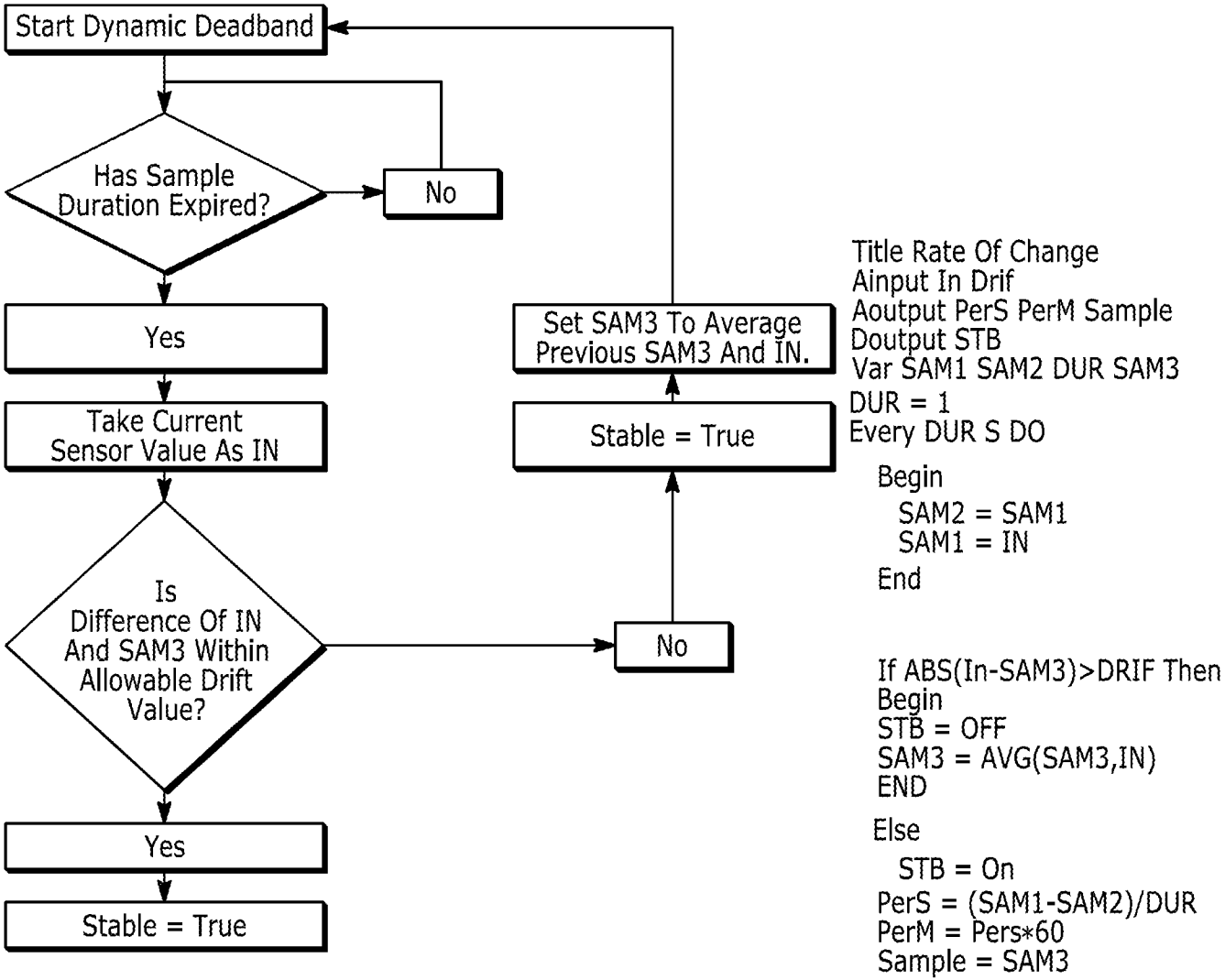
FIG. 2 shows the flowchart depicting the sensor stabilization routine of an embodiment of a Dynamic Deadband stabilization routine coded within the DD, implemented using Automated Logic's Eikon blocks.

FIG. 2 shows the flowchart depicting the sensor stabilization routine of an DD stabilization routine coded within the DD implemented using Automated Logic's Eikon blocks.

Figure 3:
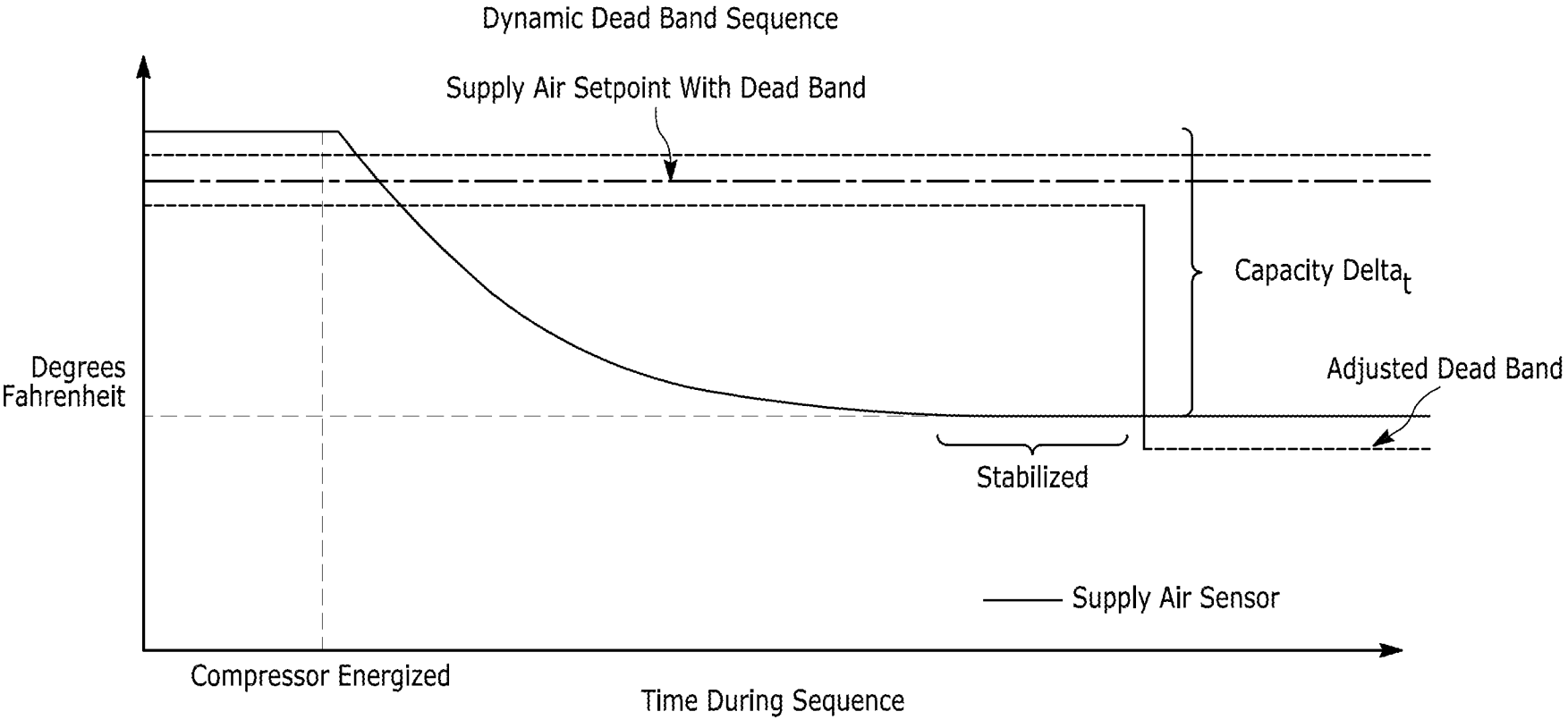
FIG. 3 illustrates a graph depicting the reaction of the Dynamic Deadband once the specified compressor is energized.

FIG. 3 illustrates a graph depicting the reaction of the Dynamic Deadband once the specified compressor is energized. As illustrated in FIG. 3, the graph depicts an example trend reading of the control sensor (indicated by Supply Air Sensor) and corresponding setpoint and upper and lower limits of the setpoint, or hysteresis points (indicated by Supply Air Setpoint with Dead Band).

The DD controlled compressor is energized, the Supply Air Sensor responds accordingly, reacting to (in this embodiment) the cooling effect of the air moving across the coil. The Stabilized section indicates the period of time that the sensor has not drifted beyond the allowable limit over time and DD indicates that the sensor is now stable. DD then calculates the new dead band lower limit (in a DX heating embodiment, it would be the upper limit) using the reading of the sensor taken before the compressor energized and after stabilization (Capacity $delta_t$). The resulting lower limit is indicated by Adjusted Dead Band, which is the Supply Air Setpoint minus the Capacity $delta_t$+2 degrees Fahrenheit.

A pseudocode depicting the Dynamic Deadband Logic is shown below:

```
If compressor required
   Var sample1 = Supply Air Sensor reading
   Energize Compressor
If boolean SA_sensor_stable is TRUE (using logic in Figure 2)
   Var Sample2 = Supply Air Sensor reading
Var capacity = absolute value of (sample1 − sample2)
If cooling
   SA_Setpoint_Lower_Deadband = Supply Air Setpoint + (capacity + 2
degrees)
If HP heating
   SAT_Setpoint_Upper_Deadband = Supply Air Setpoint + (capacity +
2 degrees).
```

Figure 4:
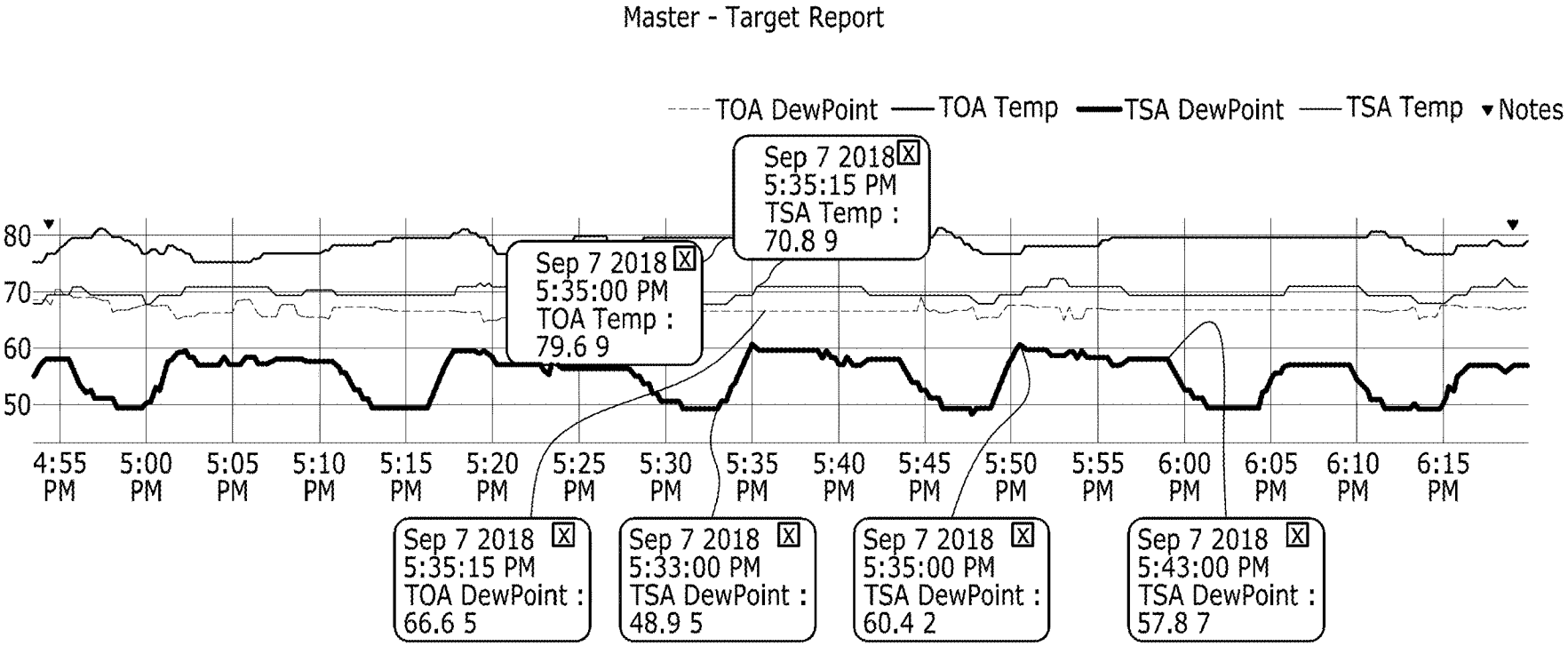
FIG. 4 shows a Dynamic Deadband disabled data capture of a unit attempting to control the supply air dew point to a setpoint of 51 degrees Fahrenheit calculated from temperature and relative humidity.
Figure 4:
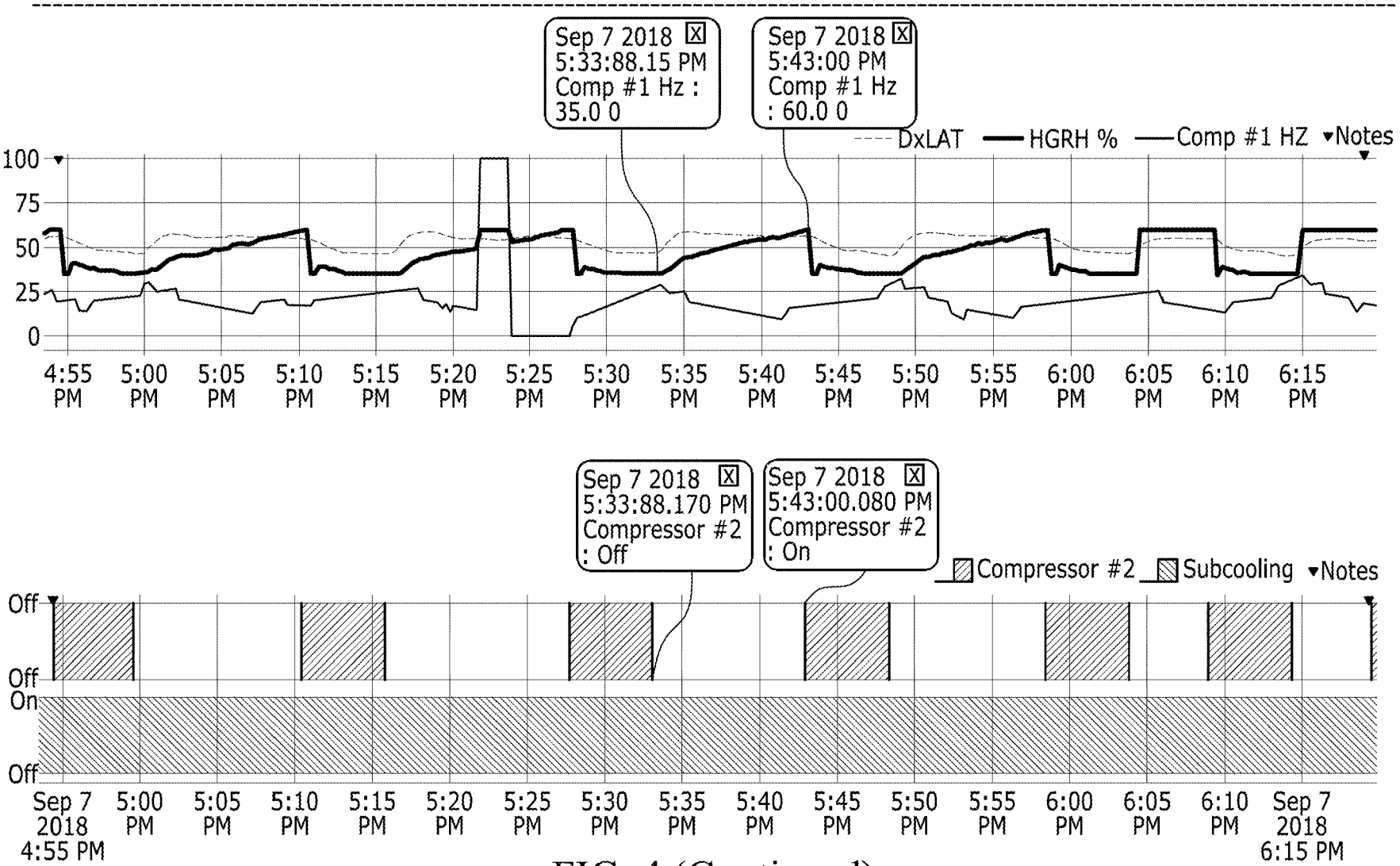
Figure 5:
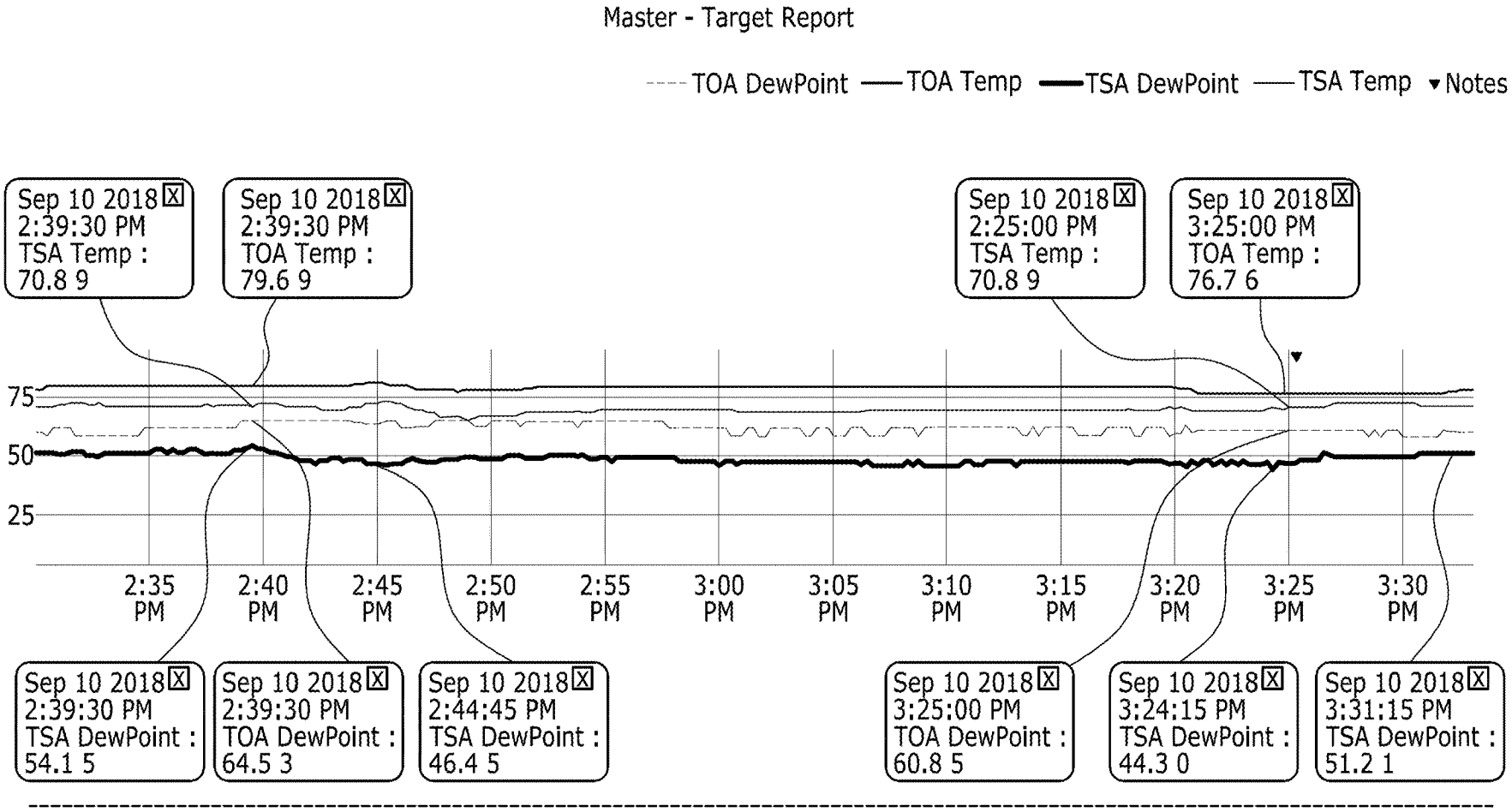
FIG. 5 shows a Dynamic Deadband—enabled data capture demonstrating the reaction of the unit with the same entering air conditions as in the previous data capture (in FIG. 4).
Figure 5:
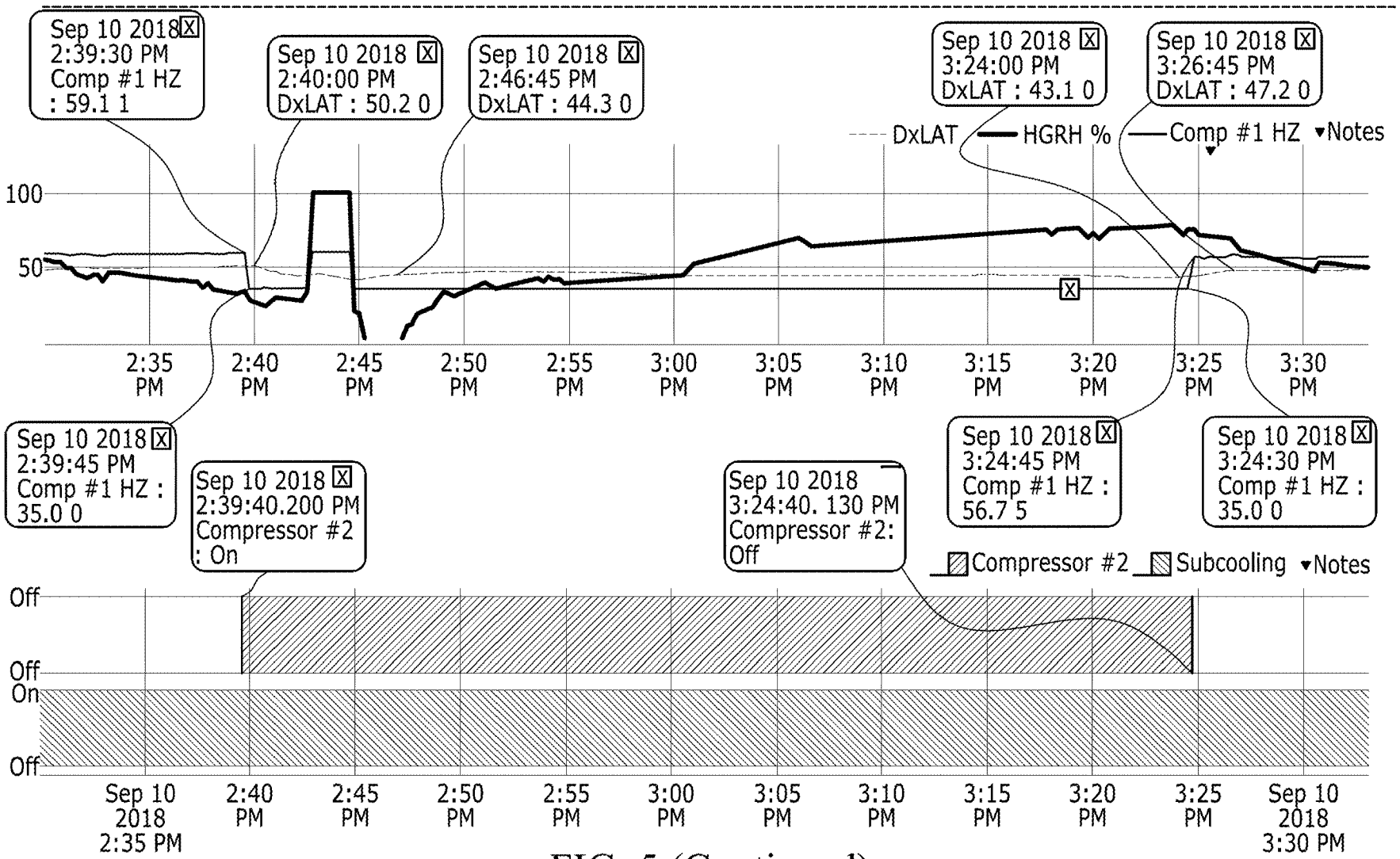

FIG. 4 shows a Dynamic Deadband disabled data capture of a unit attempting to control the supply air dewpoint to a setpoint of 51 degrees Fahrenheit calculated from temperature and relative humidity. FIG. 5 shows a Dynamic Deadband—enabled data capture demonstrating the reaction of the unit with the same entering air conditions as in the previous data capture (in FIG. 4), as discussed below.

FIG. 4 illustrates the data capture of a unit attempting to control the Supply Air Dewpoint to a setpoint of 51 degrees Fahrenheit, without enabling the Dynamic Deadband (calculated from Temperature and Relative Humidity). In FIG.

4, the unit has a variable speed Compressor #1 and fixed speed Compressor #2, wherein Compressor #1 is kept turned on, on a continuous basis. For instance, when the Supply Air Dewpoint cannot reach setpoint with Compressor #1 at 100% (60 Hertz from the Variable Frequency Drive), Compressor #2 is energized and Compressor #1 is ramped down to 35 Hertz, in a Vernier-style control method. As further illustrated, the corresponding reaction of Supply Air Dewpoint (green line, top graph) meets the setpoint and Compressor #2 is switched off. FIG. 4 demonstrates the cycling of Compressor #2 six times over an 80-minute period, totaling a runtime of ~34 minutes, with Supply Air Dewpoint swings of over 6 degrees Fahrenheit.

FIG. 5 shows a Dynamic Deadband—enabled data capture demonstrating the reaction of the unit with the same entering air conditions as in the previous data capture (illustrated in FIG. 4). As illustrated in FIG. 5—a data capture demonstrating the reaction of the unit with the same entering air conditions as in the previous data capture (as in FIG. 4), except with Dynamic Deadband enabled. As further illustrated in FIG. 5—at the moment the Supply Air Dewpoint (green line, top graph) triggers the logic to bring on Compressor #2 (by being above the setpoint of 51 by over 3 degrees F.), Compressor #1 is driven to minimum speed (~58%) and the Supply Air Dewpoint is controlled to 46 degrees F. (5 degrees F. less than the original SADP Setpoint of 51 F). At this point, the stabilization logic indicates that the leaving dewpoint is stable and the Supply Air Dewpoint Setpoint Lower Deadband is modified down 5 degrees. This allows the Compressor #2 to run continuously, avoiding the swings in Dewpoint and Temperature shown in the previous graph. Once the Supply Air Dewpoint breached the lower setpoint (by over 1.5 degrees F.), Compressor #2 was deenergized and Compressor #1 ramps to 100%. The resulting SADP ends up near the original setpoint of 51 degrees F., accomplishing the DD designed goal. The Compressor #2 runtime over the same test period as shown in FIG. 4 sums up to ~45 minutes. In the depicted embodiment, while the compressor ran about 25% longer, it avoided five compressor starts and out-of-control Supply Air swings.

It is understood that the preceding is merely a detailed description of some examples and embodiments of the present disclosure, and that numerous changes to the disclosed embodiments may be made in accordance with the disclosure made herein without departing from the spirit or scope of the disclosure. The preceding description, therefore, is not meant to limit the scope of the disclosure, but to provide sufficient disclosure to allow one of ordinary skill in the art to practice the disclosure without undue burden. It is further understood that the scope of the present disclosure fully encompasses other embodiments that may become obvious to those skilled in the art. Features illustrated or described as part of one embodiment can be used in another embodiment to yield a still further embodiment. Thus, it is intended that the present disclosure cover such modifications and variations as come within the scope of the appended claims and their equivalents. It is to be understood by one of ordinary skill in the art that the present discussion is a description of exemplary embodiments only, and is not intended as limiting the broader aspects of the present disclosure, which broader aspects are embodied in the exemplary constructions.

The invention claimed is:

1. A method for automatic sequence control of a direct expansion heating and cooling equipment, the method comprising the steps of:

configuring a programmable logic controller having a memory and in electronic communication with at least one processor;

wherein the programmable logic controller is configured to run a control algorithm;

setting a deadband around a pre-determined setpoint for controlling a set of operating parameters for the equipment;

wherein the programmable logic controller is further configured to:

calculate a variation in a temperature of the equipment based on readings from a plurality of sensors embedded in the equipment;

determine a capacity of the equipment over a certain period of time based on the sensor readings; and provide an input to the control algorithm in the event that the capacity of the equipment is outside the deadband such that the deadband is then altered to increase continuous equipment operation and reduce cycling of a compressor.

2. The method of claim 1, wherein the setpoint comprises one of a supply air dry bulb temperature or a dew point temperature related to the equipment.

3. The method of claim 2, wherein the equipment further comprises a plurality of direct expansion refrigerant compressors and heat exchangers.

4. The method of claim 3, wherein the compressors include a modulating or variable capacity motor and/or a fixed capacity motor with a single discreet stage.

5. The method of claim 1, further configured to use a time-limited control variable measurement to create a deadband adjustment and limit or eliminate short cycling of a fixed-stage compressor.

6. The method of claim 1, wherein the capacity of the equipment is based on a timed capacity measurement of a fixed-stage compressor of the equipment.

7. The method of claim 1, wherein the programmable logic controller further comprises a Proportional-Integral-Derivative (PID) control loop configured to capture the sensor readings provided by a plurality of embedded sensors and control the modulation of the compressor.

8. The method of claim 1, wherein the programmable logic controller is further configured to:

determine if fixed stage direct expansion cooling is required;

energize a corresponding fixed single-stage compressor; and continuously review if the system needs any additional capacity.

9. The method of claim 8, wherein once a fixed compressor is energized, a proprietary algorithm running within the programmable logic controller is further configured to:

command the compressor to run until a sensor measurement does not change more than a certain pre-programmed amount ($Temp_{drift}$) within a certain pre-determined time period (e.g., $Time_{seconds}$).

10. The method of claim 8, wherein the proprietary algorithm running within the programmable logic controller is further configured to measure an input from at least one of the sensors prior to energizing any additional compressors; and store the measured input ($Temp_{before}$) within the algorithm.

11. The method of claim 8, wherein a proprietary algorithm running within the programmable logic controller is further configured for:

determining a stabilization of the sensor readings;

calculating a first measurement from at least one of the sensors prior to energizing the compressor;

calculating a second measurement from the at least one of the sensors after energizing the compressor;

computing a difference between the second measurement and the first measurement; and providing a calculated temperature capacity for the equipment.

12. The method of claim 11, wherein the calculated temperature capacity is used to adjust the deadband around the setpoint to ensure continued operation and reducing or eliminating compressor cycling.

13. The method of claim 11, wherein a proprietary algorithm running within the programmable logic controller is further configured to store an average of at least past five compressor starts in order to further stabilize the deadband response and align the equipment to external conditions.

14. The method of claim 8, wherein a proprietary algorithm running within the programmable logic controller is further configured to set a lower temperature limit for the compressor and protect the equipment from freezing an evaporator coil.

15. A system for automatic sequence control of direct expansion heating and cooling equipment, the system comprising:

a programmable logic controller having a memory and in electronic communication with at least one processor;

wherein the programmable logic controller is configured to run a control algorithm;

setting a deadband around a pre-determined setpoint for controlling a set of operating parameters for the equipment;

wherein the programmable logic controller is further configured to:

calculate a variation in a temperature of the equipment based on readings from a plurality of sensors embedded in the equipment;

determine a capacity of the equipment over a certain period of time based on the sensor readings; and provide an input to the control algorithm in the event that the capacity of the equipment is outside the deadband such that the deadband is then altered to increase continuous equipment operation and reduce cycling of a compressor.

16. The system of claim 15, further configured to determine whether demand requires a primary or additional stage of direct expansion cooling or heating and running the compressor continuously in the most efficient way to deal with any partial capacity loading.

17. The system of claim 15, further configured to use a time-limited control variable measurement to create a deadband adjustment and limit or eliminate short cycling of a fixed-stage compressor.

18. The system of claim 15, wherein the capacity of the equipment is based on a timed capacity measurement of a fixed-stage compressor of the equipment.

19. The system of claim 15, wherein the programmable logic controller further comprises a Proportional-Integral-Derivative (PID) control loop configured to capture the sensor readings provided by a plurality of embedded sensors and control the modulation of the compressor.

20. The system of claim 15, the programmable logic controller is further configured to:

determine if fixed stage direct expansion cooling is required;

energize a corresponding fixed single-stage compressor; and continuously review if the system needs any additional capacity.

21. The system of claim 20, wherein once a fixed compressor is energized, a proprietary algorithm running within the programmable logic controller is further configured to:

command the compressor to run until a sensor measurement does not change more than a certain pre-programmed amount ($Temp_{drift}$) within a certain pre-determined time period (e.g., $Time_{seconds}$).

22. The system of claim 20, wherein a proprietary algorithm running within the programmable logic controller is further configured to measure an input from a sensor before energizing any additional compressors and store the measured input ($Temp_{before}$) within the algorithm.

23. The system of claim 15, wherein a proprietary algorithm running within the programmable logic controller is further configured to:

determine a stabilization of the sensor readings;

calculate a first measurement from at least one of the sensors prior to energizing the compressor;

calculate a second measurement from the at least one of the sensors after energizing the compressor;

compute a difference between the second measurement and the first measurement; and provide a calculated temperature capacity for the equipment.

24. The system of claim 23, wherein the calculated temperature capacity is used to adjust the deadband around the setpoint to ensure continued operation and reducing or eliminating compressor cycling.

25. The system of claim 20, wherein a proprietary algorithm running within the programmable logic controller is further configured to store an average of at least past five compressor starts in order to further stabilize the deadband response and align the equipment to external conditions.

26. The system of claim 15, wherein a proprietary algorithm running within the programmable logic controller is further configured to set a lower temperature limit for the compressor and protect the equipment from freezing an evaporator coil.

27. The system of claim 15, wherein the setpoint comprises of supply air dry bulb temperature or dew point temperature related to the equipment.

* * * * *